US006829964B1

(12) United States Patent
Dufendach

(10) Patent No.: US 6,829,964 B1
(45) Date of Patent: Dec. 14, 2004

(54) ACTUATION LEVER

(75) Inventor: Darl T. Dufendach, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/982,423

(22) Filed: Oct. 18, 2001

(51) Int. Cl.[7] ..... G05G 1/04
(52) U.S. Cl. ..... 74/523; 403/283; 403/329
(58) Field of Search ..... 74/523, 543, 553, 74/558, 551.9; 403/329, 283; 200/547, 5 R

(56) References Cited

U.S. PATENT DOCUMENTS

| | | | | |
|---|---|---|---|---|
| 4,466,456 A | * | 8/1984 | Hansen | 137/596.2 |
| 4,586,391 A | * | 5/1986 | Chaki | 74/10.37 |
| 5,191,971 A | * | 3/1993 | Hakkarainen et al. | 200/550 |
| 5,839,912 A | | 11/1998 | Schekalla et al. | 439/157 |
| 6,288,351 B1 | * | 9/2001 | Bruntz | 200/336 |

FOREIGN PATENT DOCUMENTS

| | | | | |
|---|---|---|---|---|
| JP | 3-246114 | * | 11/1991 | B60H/1/00 |

* cited by examiner

*Primary Examiner*—David A. Bucci
*Assistant Examiner*—Vicky A. Johnson
(74) *Attorney, Agent, or Firm*—Stefan V. Chmielewski

(57) ABSTRACT

An actuation lever is provided that comprises a lever having a first end configured to engage and support a knob, a second end configured for connection to a lever-actuated device and a longitudinal axis. The mating knob includes at least one pocket having at least one inner peripheral surface. The first end of the lever includes a resiliently deflectable retaining member having a tine that includes a barb-like tip that engages the inner peripheral surface of the pocket. As the knob is inserted onto the first end of the lever, the tine deflects inwardly towards the longitudinal axis. The spring force generated by the deflected tine causes the retaining member to exert oppositely directed forces against the inner peripheral surface of the pocket. The barb-like tip on the end of the tine imbeds into an inner peripheral surface of the pocket to retain the knob on the first end of the lever.

9 Claims, 4 Drawing Sheets

ACTUATION LEVER

TECHNICAL FIELD

The present invention relates generally to actuation levers and more particularly to an actuation lever having a knob fixedly secured thereto.

BACKGROUND OF THE INVENTION

Actuation levers that include a lever and a knob secured thereto are well known in the art. Many manufactures and/or purchasers of actuation levers typically require the knob installation force, i.e. the force required to seat a knob onto a lever, be small enough to manually install a knob without the aid of a force multiplier tool, such as a press. Similarly, the knob removal force, i.e. the force required to remove a knob from a lever, is typically required to be large enough to prevent inadvertent removal of the knob during use.

One means of securing a knob to a lever comprises the use of an adhesive to chemically bond a knob to a mating lever. The pre-cured properties of an adhesive permit a knob to be installed onto a lever with minimum force. Moreover, the retaining force of a cured adhesive readily satisfies typical minimum removal force requirements. However, application of an adhesive can be costly, given the recurring costs of the adhesive, disposable dispensing equipment, and labor. Further, the adhesive application process is vulnerable to errors, i.e. the adhesive dispenser or assembly operator may dispense too much, not enough, or no adhesive at all.

Another means of securing a knob to a lever comprises the use of a mechanical interference fit between the knob and lever. In this design, one end of a lever is typically slightly larger in geometry than a knob cavity into which the lever is inserted, thereby creating frictional interference between the two mating parts. While the use of an interference fit to secure a knob to a lever overcomes the shortcomings of using an adhesive, it does not readily satisfy specified installation and removal force requirements simultaneously. In other words, a significant interference between a lever and a knob required to satisfy a specified minimum removal force typically causes the installation force to exceed a specified maximum value. An excessively high installation force can damage the lever-actuated device, the knob being installed, or may require a force multiplier tool to install the knob.

Another means of securing a knob to a lever comprises the use of a metal retaining clip or spring designed to serve as a mechanical attachment between a knob and lever. While a spring or clip overcomes the shortcomings of an adhesive or an interference fit, it requires additional labor to assemble and adds material cost to the final product.

SUMMARY OF THE INVENTION

The present invention provides an improved actuation lever incorporating a cost-effective means of attaching a knob to a mating lever while simultaneously providing robust knob retention characteristics and an installation force low enough to manually install a knob without the aid of a force multiplier tool. In a preferred embodiment, the actuation lever comprises a lever having a first end configured to engage and support a knob, a second end configured for connection to a lever-actuated device, and a longitudinal axis. The knob includes at least one pocket having at least one inner peripheral surface. The first end of the lever includes a resiliently deflectable retaining member having a resilient tine. As the knob is inserted onto the first end of the lever, the tine deflects inwardly towards the longitudinal axis. The spring force generated by the deflected tine causes the retaining member to exert oppositely directed forces against the inner peripheral surface of the pocket. A sharply pointed tip on the end of the tine imbeds into the inner peripheral surface of the pocket to retain the knob on the first end of the lever.

Various additional aspects and advantages of this invention will become apparent to those skilled in the art from the following detailed description of the preferred embodiment, when read in light of the accompanying drawings.

BRIEF DESCRIPTION OF THE DRAWINGS

The features and inventive aspects of the present invention will become more apparent upon reading the following detailed description, claims, and drawings, of which the following is a brief description:

DESCRIPTION OF THE PREFERRED EMBODIMENT

Figure 1:
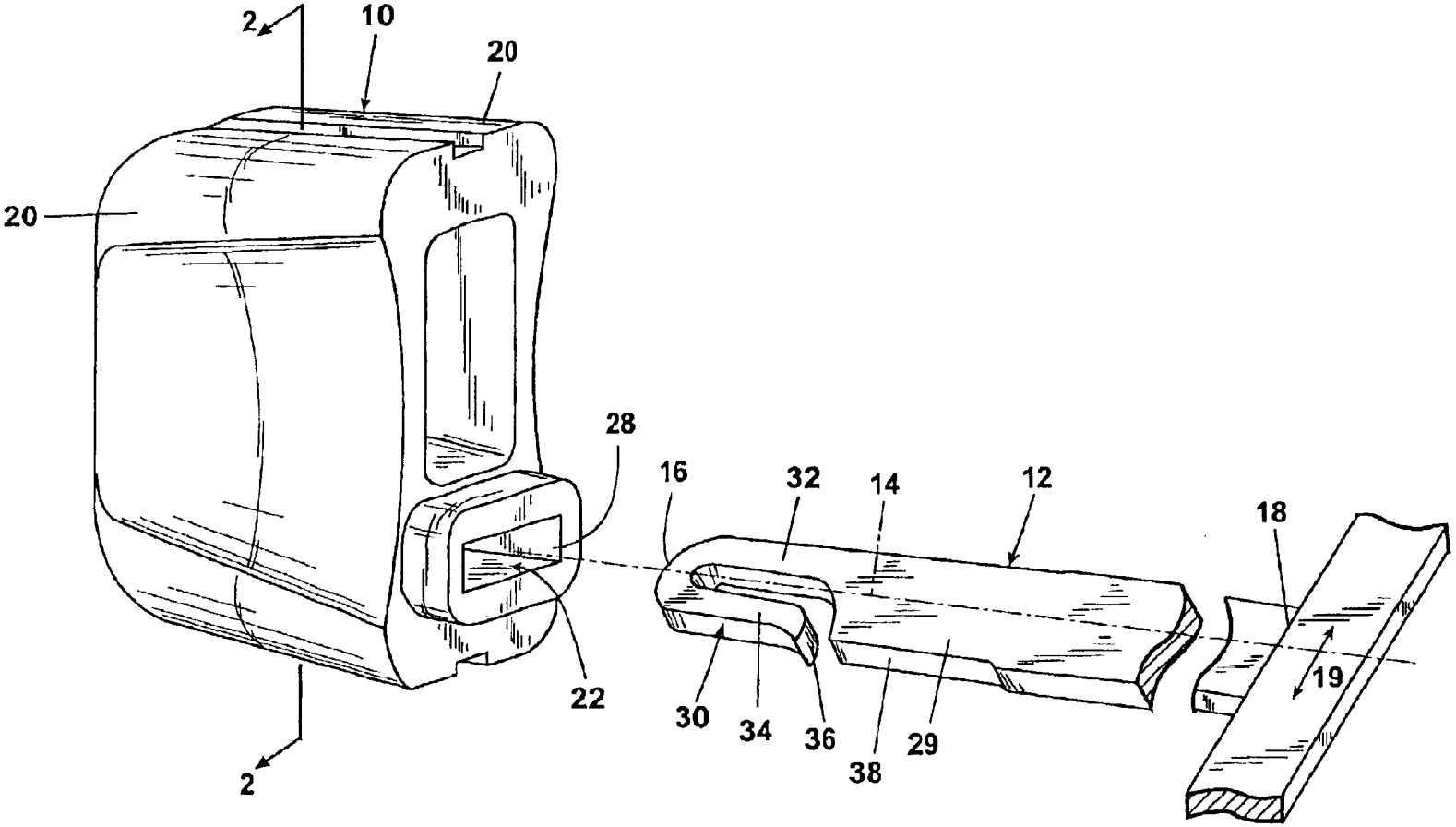
FIG. 1 is a perspective view of an actuation lever according to a preferred embodiment of the present invention showing a knob and a lever.

Referring now to the drawings, the preferred embodiment of the present invention is described in detail. While the inventive actuation lever may be employed in various mechanical or electromechanical systems, the inventive actuation lever is particularly suited for application as an actuator lever in a vehicle climate control unit. Lever-actuated functions for a vehicle climate control unit may include, but are not limited to, blower speed, temperature, and mode selection.

Referring to FIG. 1 of the drawings, a preferred embodiment of the present invention is shown that includes a knob 10 and a substantially elongated lever 12 having a longitudinal axis 14. Lever 12 fixedly carries at its upper end 16 the knob 10 and is, at its lower end 18, coupled to a device that is to be operated by transfer of the operative movement. In a preferred embodiment, the operative movement of the lever 12 is a sliding movement causing substantial sideways movement of knob 10 along an axis 19, i.e. perpendicular to longitudinal axis 14. However, it is recognized that the movement direction of lever 12 is not critical to this invention, and other movement directions, such as rotational or rocking movement, are also contemplated.

Figure 2:
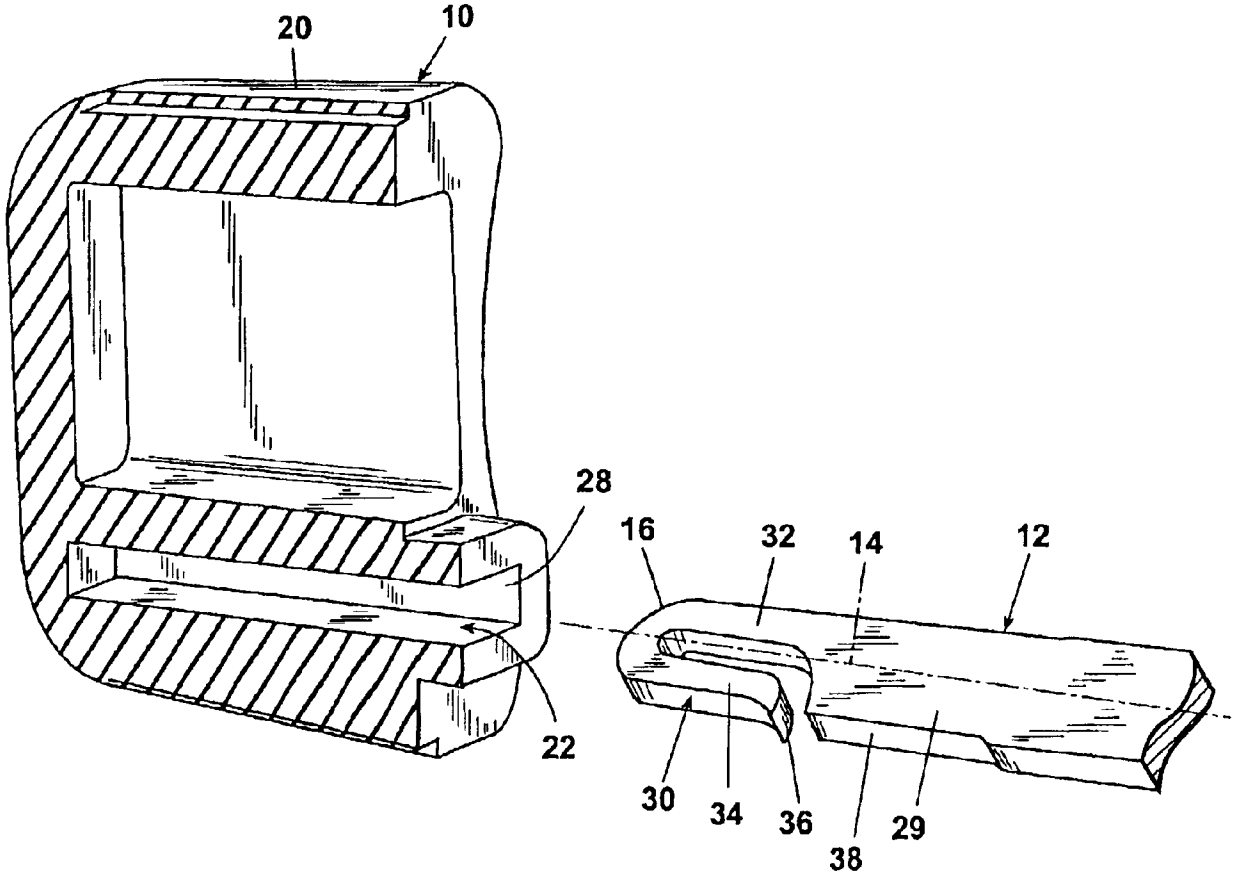
FIG. 2 is a perspective view showing a cross-section of the knob according to the preferred embodiment.
Figure 3A:
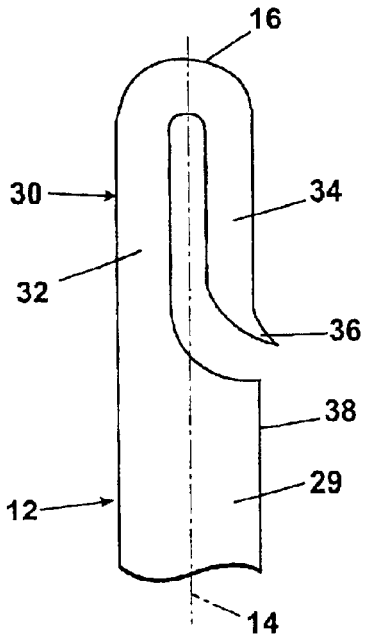
FIG. 3A is an elevation view of a lever according to the preferred embodiment prior to installation of the knob.
Figure 3B:
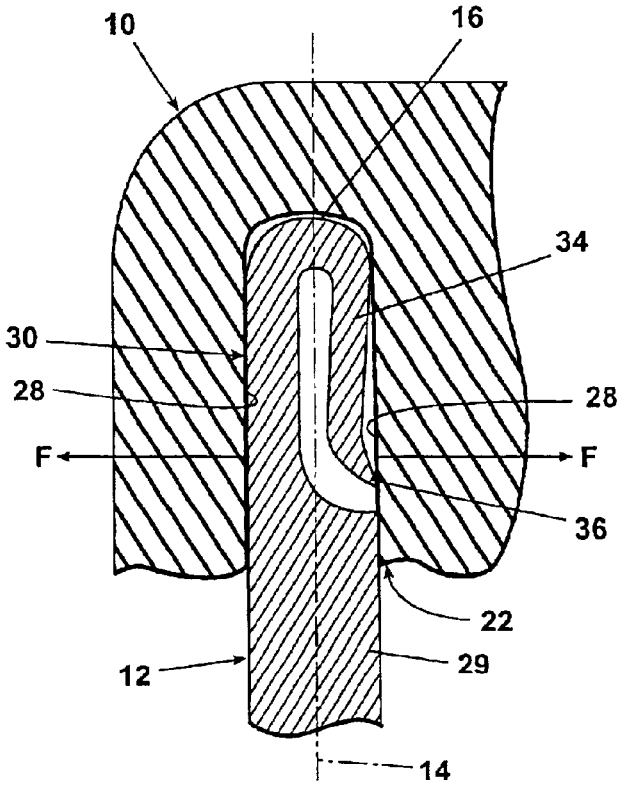
FIG. 3B is a cross-sectional view of a knob installed on a lever according to the preferred embodiment.

In a preferred embodiment, knob 10 comprises a polymeric material such as ABS or a similar thermoplastic. As shown in FIG. 2, knob 10 preferably exhibits a substantially rectangular cross-section having an exterior surface 20 and at least one pocket 22. Knob pocket 22 preferably includes a plurality of inner peripheral surfaces 28 configured to receive lever 12. At least two inner peripheral surfaces 28 may be tapered, as shown in FIG. 3B, to facilitate ejection of knob 10 from a thermoplastic injection mold.

Alternatively, knob 10 may exhibit a non-rectangular cross-section, such as a cylindrical cross-section, or any other geometric shape and size capable of incorporating pocket 22.

In a preferred embodiment, lever 12 is comprised of metal, such as steel or aluminum, having a body 29 with a substantially rectangular cross-section. As illustrated in FIG. 3A of the drawings, upper end 16 of lever 12 includes an integrally formed self-locking retaining member 30 designed to project into pocket 22 of knob 10. Retaining member 30 preferably exhibits a substantially arched profile defining a first half 32 that extends upwardly from body 29 and a second half comprising a deflectable tine 34 that extends downwardly from upper end 16 to a barb-like tip 36.

Prior to installation of knob 10, as shown in FIG. 3A, tip 36 of tine 34 projects slightly beyond an outer wall 38 of lever 12. Referring to FIG. 3B, as knob 10 is installed onto lever 12, tip 36 engages an inner peripheral surface 28 of pocket 22 causing tine 34 to deflect inwardly towards longitudinal axis 14. The material of lever 12 is sufficiently elastic to allow retaining member 30 to exert a force F at tip 36 as tine 34 is deflected toward longitudinal axis 14. The spring force of deflected tine 34 further causes retaining member 30 to exert an oppositely directed force F against an inner peripheral surface 28 opposite the inner peripheral surface 28 engaged by tip 36.

Tip 36 is preferably configured as a sharp point to facilitate engagement with an inner peripheral surface 28 in pocket 22. Once a knob and lever are mated, the relatively soft polymeric material of knob 10 experiences local deformation at the point of engagement with tip 36. The harder, metallic tip 36 "bites" or imbeds itself into an inner peripheral surface 28 of pocket 22 to inhibit removal of knob 10 from lever 12. Moreover, subsequent attempts to pull knob 10 from lever 12 causes tip 36 to imbed further into inner peripheral surface 28, thereby increasing the force required to remove knob 10 from lever 12.

In a preferred embodiment, the inventive actuation lever is configured such that the force required to install knob 10 onto lever 12 is no more than approximately 50 N (11.3 lbf), and the removal force is at least approximately 20 N (4.5 lbf). An installation force of less than approximately 50 N permits knob 10 to be manually installed on lever 12 without the aid of a force multiplier tool, such as a press. It may be appreciated by those skilled in the art that other installation and removal force requirements may be specified depending upon the application. Accordingly, the material of lever 12 and knob 10 and/or the dimensions of the retaining member 30 and pocket 22 may be modified, for example, to satisfy specific installation and removal force requirements.

Figure 4:
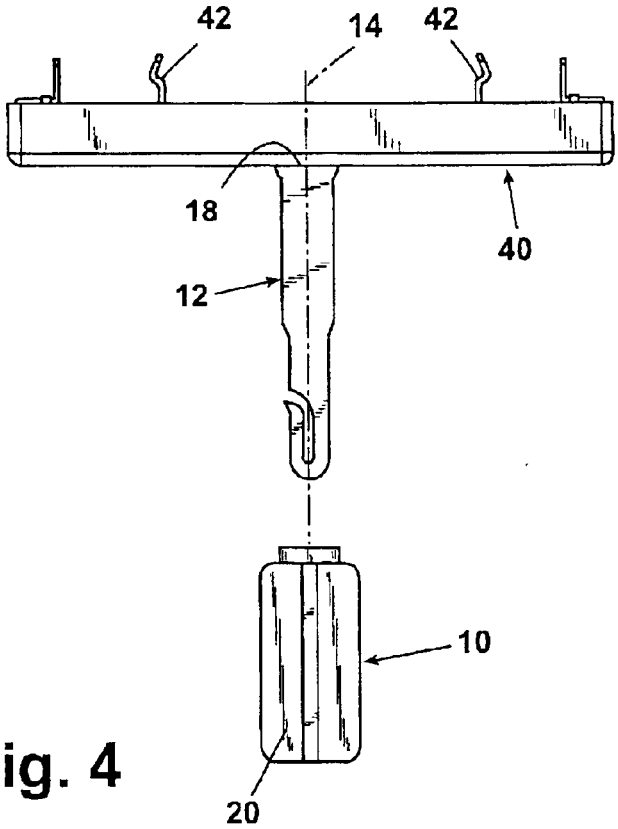
FIG. 4 is a top view of a lever secured to a device prior to installation of a knob.
Figure 5:
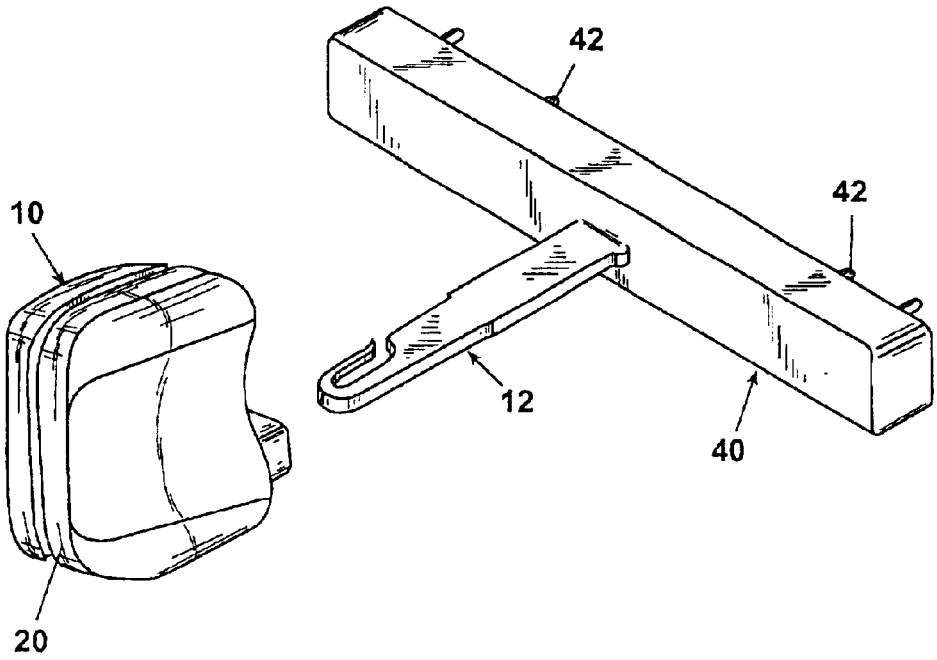
FIG. 5 is a perspective view of a lever secured to a lever-actuated device prior to installation of a knob.

Referring to FIGS. 4 and 5, the lower end 18 of the lever 12 is secured to a sliding component inside a lever-actuated device 40. In a preferred embodiment, device 40 is a slide potentiometer soldered at terminals 42 to a circuit board within a vehicle climate control unit (not illustrated). In this application, the slide potentiometer provides manual adjustment of cabin air temperature. The orientation of the affixed lever 12 may be modified without degrading the retaining force exerted against knob 10. For example, the lever 12 may be oriented as shown in FIG. 4 or may be rotated 180° about longitudinal axis 14.

Among other advantages, the inventive actuation lever provides a knob/lever interface, in the form of retaining member 30, that simultaneously provides the robust knob retention characteristics of an adhesive and an installation force low enough to manually install a knob without the aid of a force multiplier tool. While the inventive retaining member 30 is particularly suited to retain a knob on a lever, the inventive retaining member 30 may be employed in any structure where it is desired to mechanically attach a member having a relatively softer material to a member having a relatively harder material. For example, retaining member 30 may be utilized to secure other components in a vehicle, such as to attach a door panel to a vehicle door.

Although certain preferred embodiments of the present invention have been described, the invention is not limited to the illustrations described and shown herein, which are deemed to be merely illustrative of the best modes of carrying out the invention. A person of ordinary skill in the art will realize certain modifications and variations will come within the teachings of this invention, and such variations and modifications are within its spirit and the scope as defined by the claims.

What is claimed is:

1. An actuation lever assembly for operating a vehicle climate control unit, said actuation lever comprising:

a knob that includes a pocket having at least one inner peripheral surface;

a lever having a first end received in the pocket, said first end having a resiliently deflectable retaining member that engages at least one inner peripheral surface of said knob pocket to retain said knob on said lever, wherein said retaining member is harder than said knob, and wherein said retaining member includes a sharply pointed tip that pierces an inner peripheral surface of said knob pocket upon installation of said knob.

2. An actuation lever assembly as recited in claim 1, wherein said retaining member is integrally formed with said lever.

3. An actuation lever assembly as recited in claim 1, wherein said retaining member exhibits a substantially arched profile defining a first portion that extends inwardly and a second portion comprising a deflectable tine that extends outwardly from said first portion.

4. An actuation lever assembly as recited in claim 3, wherein said tine deflects inwardly towards said longitudinal axis upon installation of said knob.

5. An actuation lever assembly as recited in claim 4, wherein a spring force generated by said deflected tine causes said retaining member to exert oppositely directed forces against at least one inner peripheral surface.

6. An actuation lever assembly as recited in claim 1, wherein said knob comprises a polymeric material and said lever comprises a metal.

7. An actuation lever assembly as recited in claim 1, wherein the force to apply said knob onto said lever does not exceed approximately 50 N.

8. An actuation lever assembly as recited in claim 1, wherein the force to remove said knob from said lever is at least approximately 20 N.

9. An actuation lever assembly for operating a vehicle climate control unit, said actuation lever comprising:

a knob that includes a pocket having at least one inner peripheral surface;

a lever having a first end received in the pocket, a second end configured for connection to the climate control unit and a longitudinal axis, said first end having a resiliently deflectable retaining member that engages at least one inner peripheral surface of said knob pocket to retain said knob on said lever; and wherein said retaining member exhibits a substantially arched profile defining a first portion that extends inward toward the longitudinal axis and a second portion comprising a deflectable tine that extends outward relative to the longitudinal axis to a sharply pointed tip, said tine deflecting inwardly towards said longitudinal axis upon installation of said knob, and said sharply pointed tip piercing an inner peripheral surface of said knob pocket upon installation of said knob.

* * * * *